US011488504B2

(12) United States Patent
Tang

(10) Patent No.: US 11,488,504 B2
(45) Date of Patent: Nov. 1, 2022

(54) DRIVING CIRCUIT, METHOD FOR DETERMINING CONNECTION INFORMATION OF DRIVING CIRCUIT AND DISPLAY DEVICE

(71) Applicants: CHONGQING HKC OPTOELECTRONICS TECHNOLOGY CO., LTD., Chongqing (CN); HKC Corporation Limited, Guangdong (CN)

(72) Inventor: Li Tang, Chongqing (CN)

(73) Assignees: Chongqing HKC Optoelectronics Technology Co., Ltd., Chongqing (CN); HKC Corporation Limited, Guangdong (CN)

( * ) Notice: Subject to any disclaimer, the term of this patent is extended or adjusted under 35 U.S.C. 154(b) by 0 days.

(21) Appl. No.: 17/298,217

(22) PCT Filed: May 6, 2020

(86) PCT No.: PCT/CN2020/088752
§ 371 (c)(1),
(2) Date: May 28, 2021

(87) PCT Pub. No.: WO2020/224587
PCT Pub. Date: Nov. 12, 2020

(65) Prior Publication Data

US 2022/0093021 A1 Mar. 24, 2022

(30) Foreign Application Priority Data

May 6, 2019 (CN) ..... 201910370697.4

(51) Int. Cl.
*G09G 3/00* (2006.01)
*G09G 3/36* (2006.01)

(52) U.S. Cl.
CPC ..... *G09G 3/006* (2013.01); *G09G 3/36* (2013.01); *G09G 2300/0833* (2013.01);
(Continued)

(58) Field of Classification Search
CPC .. G09G 3/006; G09G 3/36; G09G 2300/0833; G09G 2310/0243;
(Continued)

(56) References Cited

U.S. PATENT DOCUMENTS 7,928,954 B1 * 4/2011 Chen ..... H03K 19/0016 345/82
8,537,088 B2 * 9/2013 Xiao ..... G09G 3/3688 345/98
(Continued)

FOREIGN PATENT DOCUMENTS

CN 109256104 A 1/2019
CN 109584781 A 4/2019
(Continued)

OTHER PUBLICATIONS

International Search Report for Application No. PCT/CN2020/088752 dated Aug. 13, 2020, 4 pages.

*Primary Examiner* — Michael J Jansen, II
(74) *Attorney, Agent, or Firm* — Rosenberg, Klein & Lee

(57) ABSTRACT

A driving circuit includes a gamma chip configured to provide a plurality of initial binding point voltages; the gamma chip including a first type of output terminals and a second type of output terminals, currents corresponding to the initial binding point voltages outputted by the first type of output terminals being less than a preset driving current; and currents corresponding to the initial binding point voltages outputted by the second type of output terminals
(Continued)

being greater than the preset driving current; and a data driving chip including a processor and a plurality of operational amplifiers.

17 Claims, 7 Drawing Sheets

(52) U.S. Cl.
CPC ..... *G09G 2310/0243* (2013.01); *G09G 2310/0272* (2013.01); *G09G 2310/0291* (2013.01); *G09G 2320/0276* (2013.01)

(58) Field of Classification Search
CPC ... G09G 2310/0272; G09G 2310/0291; G09G 2320/0276; G09G 2290/00; G09G 3/2092; G09G 3/3696; G09G 2300/043; G09G 3/20
See application file for complete search history.

(56) References Cited

U.S. PATENT DOCUMENTS 8,884,677 B1 * 11/2014 Huang ..... H03F 3/387 327/307
9,275,600 B2 * 3/2016 Zhu ..... G09G 3/3688
9,343,010 B2 * 5/2016 Yang ..... G09G 3/3291
9,437,145 B2 * 9/2016 Han ..... G09G 3/3696
9,640,128 B2 * 5/2017 Xu ..... G09G 3/3611
9,940,882 B2 * 4/2018 Zhu ..... G09G 3/3696
10,152,934 B2 * 12/2018 Huang ..... G09G 3/36
10,380,942 B2 * 8/2019 An ..... G09G 3/3233
10,878,738 B1 * 12/2020 Ju ..... G09G 3/20
10,930,190 B2 * 2/2021 Wang ..... G09G 3/20
11,068,094 B2 * 7/2021 Lee ..... G09G 3/3688
11,127,366 B2 * 9/2021 Lee ..... G09G 3/3696
11,195,451 B2 * 12/2021 Han ..... G09G 3/2092
11,341,915 B2 * 5/2022 Yin ..... G09G 3/3258
2008/0259013 A1 * 10/2008 Kobayashi ..... G09G 3/20 345/89
2010/0245325 A1 * 9/2010 Xiao ..... G09G 3/3688 345/211
2010/0265274 A1 * 10/2010 Han ..... G09G 3/3688 345/89
2011/0089979 A1 * 4/2011 Chen ..... H03K 19/017 327/108
2015/0187263 A1 * 7/2015 Yang ..... G09G 3/3216 345/212
2015/0187300 A1 * 7/2015 Sun ..... G09G 3/2096 345/87
2015/0279300 A1 * 10/2015 Zhu ..... G09G 3/3688 345/88
2015/0339987 A1 * 11/2015 Han ..... G09G 3/3696 345/89
2016/0196793 A1 * 7/2016 Xu ..... G09G 3/3413 345/694
2017/0178576 A1 * 6/2017 Zhu ..... G09G 3/3696
2018/0144701 A1 * 5/2018 Huang ..... G09G 3/3648
2018/0166515 A1 * 6/2018 An ..... G09G 3/3225
2020/0050310 A1 * 2/2020 Lee ..... G06F 3/0418
2020/0051478 A1 * 2/2020 Wang ..... G09G 3/20
2021/0012743 A1 * 1/2021 Lee ..... G09G 3/3258
2021/0074201 A1 * 3/2021 Han ..... G09G 3/2092
2021/0134239 A1 * 5/2021 Wang ..... G09G 3/3688
2021/0335256 A1 * 10/2021 Yin ..... G09G 3/3291
2022/0013079 A1 * 1/2022 Hu ..... G09G 3/006

FOREIGN PATENT DOCUMENTS

CN 109671406 A 4/2019
CN 110176206 A 8/2019
CN 110223654 A 9/2019

* cited by examiner

DRIVING CIRCUIT, METHOD FOR DETERMINING CONNECTION INFORMATION OF DRIVING CIRCUIT AND DISPLAY DEVICE

CROSS REFERENCE TO RELATED APPLICATIONS

This is a U.S. National Stage application of, and claims priority to, PCT/CN2020/088752, filed May 6, 2020, which further claims priority to Chinese Patent Application No. 201910370697.4, filed May 6, 2019, the disclosures of which are incorporated herein by reference in their entirety.

TECHNICAL FIELD

The present disclosure relates to the field of display drive technologies, more particularly, to a driving circuit, a method for determining connection information of a driving circuit and a display device.

BACKGROUND

The description herein provides only background information related to the present disclosure and does not necessarily constitute the prior art.

With increasingly fierce competition in the liquid crystal panel industry, panel manufacturers are also increasingly strict in controlling costs. reduction of costs is considered from the perspective of design of a Printed Circuit Board Assembly (PCBA) board (a plate after a PCB bare board goes through the whole process of Surface Mounted Technology (SMT) loading or Dual In-line Package (DIP) plugging), mainly involving the consideration of aspects such as evaluation and selection of a new chip, a dimension of the PCBA board, and wiring design. An 8-bit digital signal of a data driving chip is converted into an analog signal of the corresponding potential by a digital-to-analog converter. The analog signal is applied to two poles of liquid crystal molecules to control the liquid crystal molecules to flip by a corresponding angle. The angle is artificially divided into 0 to 255 equal parts, which correspond to gray scales of L0 to L255 displayed on a panel. The 8-bit digital signal can be controlled to control a display screen of a liquid crystal panel. In general, human eyes are most sensitive to the brightness of a low gray scale, so gamma correction is often introduced in the design to make the brightness perceived by the human eyes correspond to data received by the liquid crystal panel.

The number of voltage channels outputted by a gamma chip needs to correspond to the number of binding points of the data driving chip, and a voltage outputted by the gamma chip needs to meet the requirements of driving the data driving chip. A larger panel size requires greater driving capability.

When some gamma binding point voltages are generated according to two or more gamma voltages outputted by the gamma chip for resistance voltage division, taking 14 groups of binding point voltages as an example, potentials of the 14 groups of binding point voltages can satisfy a binding point voltage level, but the potentials of the binding point voltages cannot meet the requirements of the driving capability when transmitted to the data driving chip. At present, with respect to the problem, an external controller is often used to control a plurality of gamma chips, and binding point voltages outputted by the gamma chips are adjusted according to the requirements of the driving capability. Such a solution requires a plurality of control chips and a plurality of gamma chips, which leads to a high cost, a complex structure and a long maintenance cycle when a fault occurs.

SUMMARY

Based on this, embodiments of the present disclosure provide a driving circuit, a method for determining connection information of a driving circuit and a display device.

In one aspect, an embodiment of the present disclosure provides a driving circuit, including:

a gamma chip configured to provide a plurality of initial binding point voltages; the gamma chip including a first type of output terminals and a second type of output terminals, currents corresponding to the initial binding point voltages outputted by the first type of output terminals being less than a preset driving current; and currents corresponding to the initial binding point voltages outputted by the second type of output terminals being greater than the preset driving current; and a data driving chip including a processor and a plurality of operational amplifiers, output terminals of the operational amplifiers being correspondingly connected to terminals on the processor and being further connected to their own inverting input terminals; the first type of output terminals of the gamma chip being connected to non-inverting input terminals of one part of the operational amplifiers; and the second type of output terminals of the gamma chip being connected to the inverting input terminals of the other part of the operational amplifiers, and the non-inverting input terminals of the operational amplifiers being grounded;

wherein the preset driving current is a current representing driving capability required for driving a display panel, and an output terminal of the data driving chip is connected to the display panel.

In the driving circuit according to the embodiment of the present disclosure, operational amplifiers built in a data driving chip are used, and then according to whether currents corresponding to the initial binding point voltages outputted by a gamma chip can meet requirements of driving capability of a display panel (i.e., determining whether the currents are greater than a preset driving current), for an initial binding point voltage that cannot meet the requirements of driving capability, a first type of output terminals corresponding thereto are connected to a non-inverting input terminal of an operational amplifier, so that the current of the initial binding point voltage can be amplified through the operational amplifier. After amplification, the current of the outputted binding point voltage increases, which can meet the requirements of the driving capability and be transmitted to a corresponding terminal on a processor. An initial binding point voltage that already can meet the requirements of the driving capability does not need to be amplified, a second type of output terminals can be connected to an inverting input terminal of an operational amplifier, and a non-inverting input terminal of the operational amplifier is grounded to make non-inverting input zero, so that the corresponding operational amplifier has no amplification effect and the initial binding point voltage generated by the gamma chip is directly transmitted to a corresponding terminal on the processor. Different initial binding point voltages are connected in different manners by using the built-in operational amplifiers, so that the binding point voltages inputted to the processor can meet the requirements of the driving capability of the display panel. The driving circuit features a simple structure and a low cost.

In one embodiment, the plurality of operational amplifiers are voltage followers.

In the driving circuit according to the embodiment of the present disclosure, the operational amplifiers in the data driving chip are voltage followers, and mainly play a role of voltage following and current amplification, so that potentials of new binding point voltages generated after amplification can meet a binding point voltage level, and currents thereof can meet the requirements of the driving capability of the display panel.

In one embodiment, the driving circuit further includes: a first resistor with one end connected to the first type of output terminals of the gamma chip and the other end connected to the non-inverting input terminals of the corresponding operational amplifiers.

In one embodiment, the driving circuit further includes:

a second resistor with one end connected to the second type of output terminals of the gamma chip and the other end connected to inverting input terminals of the corresponding operational amplifiers; and a third resistor with one end connected to the non-inverting input terminals of the operational amplifiers and the other end grounded.

In one embodiment, the first resistor is a zero-ohm resistor.

In one embodiment, the second resistor and the third resistor are both zero-ohm resistors.

In one embodiment, the initial binding point voltages one-to-one correspond to the operational amplifiers.

In another aspect, an embodiment of the present disclosure further provides a method for determining connection information of a driving circuit, wherein the driving circuit includes: a gamma chip configured to provide a plurality of initial binding point voltages; and a data driving chip including a processor and a plurality of operational amplifiers, output terminals of the operational amplifiers being correspondingly connected to terminals on the processor and being further connected to their own inverting input terminals; wherein the method includes:

acquiring currents corresponding to the initial binding point voltages outputted by the gamma chip;

determining whether the currents are greater than a preset driving current;

if the currents are less than the preset driving current, determining that the output terminals of the gamma chip corresponding to the currents are a first type of output terminals, and generating first connection information that makes the first type of output terminals of the gamma chip correspondingly connected to non-inverting input terminals of one part of the operational amplifiers;

if the currents are greater than the preset driving current, determining that the output terminals of the gamma chip corresponding to the currents are a second type of output terminals, and generating second connection information that makes the second type of output terminals of the gamma chip correspondingly connected to inverting input terminals of the other part of the operational amplifiers and makes non-inverting input terminals of the operational amplifiers grounded;

wherein the preset driving current is a current representing driving capability required for driving a display panel, and an output terminal of the data driving chip is connected to the display panel.

In one embodiment, the method for determining connection information of the driving circuit further includes:

displaying, according to pre-stored image data of the gamma chip, image data of the data driving chip, the first connection information and the second connection information, a layout in which the first types of output terminals and the second types of output terminals of the gamma chip are correspondingly connected to the operational amplifiers.

In one embodiment, the method for determining connection information of the driving circuit further includes: displaying an image of the gamma chip and an image of the data driving chip according to pre-stored image data of the gamma chip and image data of the data driving chip.

In one embodiment, the plurality of operational amplifiers are voltage followers.

In one embodiment, the method for determining connection information of the driving circuit further includes: generating an architecture diagram of the driving circuit according to the connection layout of the driving circuit.

In one embodiment, the method for determining connection information of the driving circuit further includes:

sending the first connection information and the second connection information to a control terminal.

In one embodiment, the method for determining connection information of the driving circuit further includes:

after receiving the first connection information and the second connection information, storing, by the control terminal, corresponding parameters of the gamma chip and parameters of the data driving chip in a manner of corresponding to the received first connection information and second connection information.

In one embodiment, the method for determining connection information of the driving circuit further includes:

generating a manufacturing scheme for the driving circuit according to the received first connection information and second connection information and the stored parameters of the gamma chip and parameters of the data driving chip.

A display device includes a display panel and the driving circuit described above.

Details of one or more embodiments of the present disclosure are proposed in the following drawings and description. Other features, objectives and features of the present disclosure will become obvious from the specification, drawings and claims.

DETAILED DESCRIPTION OF THE EMBODIMENTS

Figure 1:
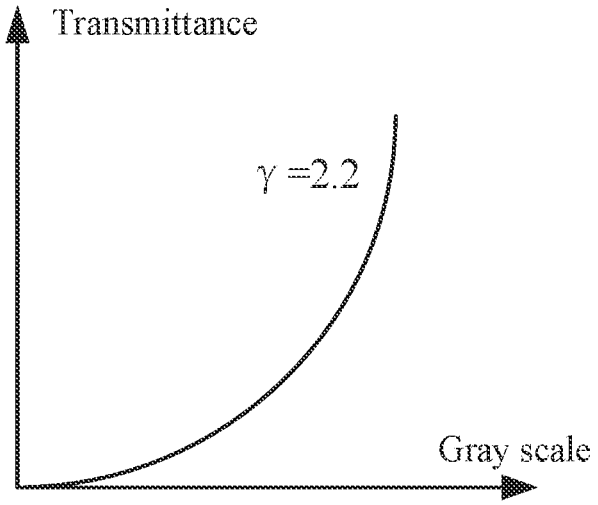
FIG. 1 is a schematic diagram of a standard gamma 2.2 curve in an exemplary technology.

To facilitate understanding of the present disclosure, a more comprehensive description of the present disclosure will be given below with reference to the relevant drawings. Preferred embodiments of the present disclosure are given in the drawings. However, the present disclosure may be implemented in many different forms but is not limited to the embodiments described herein. Rather, these embodiments are provided to make the contents disclosed in the present disclosure more fully understood.

It should be noted that when one element is referred to as "attached to" another element, it may be directly connected to and integrated with the other element, or an intermediate element may exist. The terms "mount", "one end", "the other end" and similar expressions used herein are for illustrative purposes only.

Unless defined otherwise, all technical and scientific terms used herein have the same meanings as are commonly understood by those skilled in the art. The terms used herein in the specification of the present disclosure are for the purpose of describing specific embodiments only but not intended to limit the present disclosure. The term "and/or" used herein includes any and all combinations of one or more related listed items.

At present, gamma chips (gamma IC, gamma Integrated Circuit) used by most manufacturers include 14 or 16 binding points, which are classified into two groups according to positive and negative polarities. A greater number of binding points indicates that the gamma curve is closer to $\gamma=2.2$ curve (the standard gamma 2.2 curve) shown in FIG. 1, but it is correspondingly more difficult to adjust the gamma curve. Currently, 14 or 16 binding points are generally used to make the gamma curve close to the standard gamma 2.2 curve. There are currently some data driving chips provided with an operational amplifier function.

Figure 2:
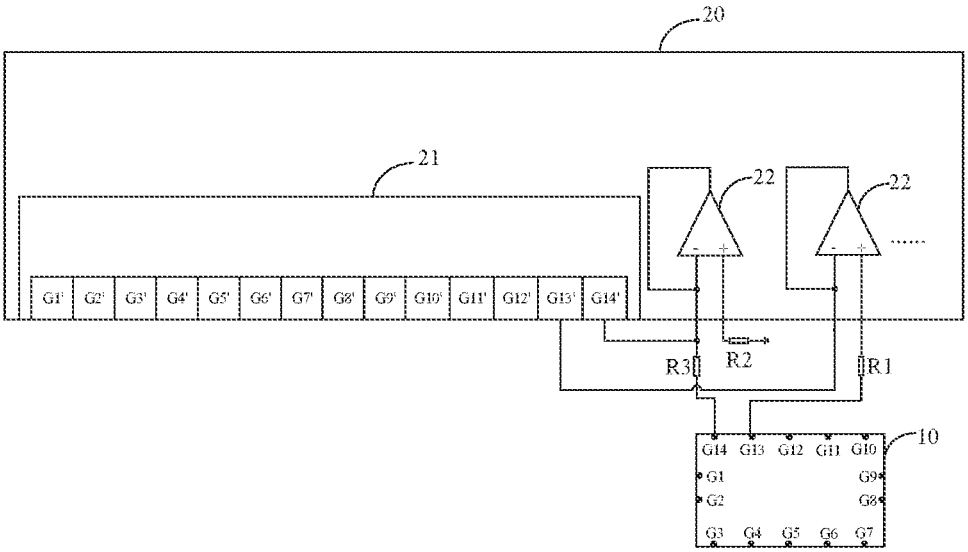
FIG. 2 is a schematic structural diagram of a driving circuit according to an embodiment.

An embodiment of the present disclosure provides a driving circuit, as shown in FIG. 2, including: a gamma chip 10 configured to provide a plurality of initial binding point voltages; and a data driving chip 20. The gamma chip 10 includes a first type of output terminals and a second type of output terminals, currents corresponding to the initial binding point voltages outputted by the first type of output terminals are less than a preset driving current; and currents corresponding to the initial binding point voltages outputted by the second type of output terminals are greater than the preset driving current. The data driving chip 20 includes a processor 21 and a plurality of operational amplifiers 22, output terminals of the operational amplifiers 22 are correspondingly connected to terminals on the processor 21, and the output terminals of the operational amplifiers 22 are further connected to their own inverting input terminals. The first type of output terminals of the gamma chip 10 are connected to non-inverting input terminals of one part of the operational amplifiers 22. The second type of output terminals of the gamma chip 10 are connected to the inverting input terminals of the other part of the operational amplifiers 22, and the non-inverting input terminals of the operational amplifiers 22 are grounded. The preset driving current is a current representing driving capability required for driving a display panel, and an output terminal of the data driving chip 20 is connected to the display panel.

The gamma chip 10 refers to a device that can output a plurality of gamma voltages to calibrate data driving signals. The gamma chip 10 is not limited to only including a CPU, but also may include elements such as a voltage-dividing resistor. With the above connection, in a situation where the currents corresponding to the initial binding point voltages are less than the preset driving current, the first type of output terminals of the gamma chip 10 are connected to the non-inverting input terminals of the operational amplifiers 22, the initial binding point voltages are transmitted to the operational amplifiers 22 through the non-inverting input terminals of the operational amplifiers 22, and after amplification, are transmitted to corresponding terminals on the processor 21 through output terminals of the operational amplifiers 22. The inverting input terminals of the operational amplifiers 22 are connected to the output terminals thereof to form negative feedback. For example, as shown in FIG. 2, if a current corresponding to an initial binding point voltage outputted by an output terminal G13 of the gamma chip 10 is less than the preset driving current, the initial binding point voltage needs to be amplified, the initial binding point voltage outputted by the output terminal G13 is inputted from a non-inverting input terminal of an operational amplifier 22, the operational amplifier 22 is in an amplification state, and a new binding point voltage generated after amplification is amplified in terms of driving capability and is transmitted from the output terminal to an terminal G13' on the processor 21. It needs to be noted that in order to avoid the interaction between the initial binding point voltages when amplified by the operational amplifiers 22, the initial binding point voltages one-to-one correspond to the operational amplifiers 22.

Similarly, when the currents corresponding to the initial binding point voltages are greater than the preset driving current, the inverting input terminals of the operational amplifiers 22 are connected to the second type of output terminals of the gamma chip 10, and the non-inverting input terminals of the operational amplifiers 22 are grounded. Since the non-inverting input terminals of the operational amplifiers 22 are grounded, a non-inverting input signal is zero. Since output terminals of the operational amplifiers 22 are connected to the inverting input terminals thereof, the initial binding point voltages are directly transmitted to corresponding terminals on the processor 21 through the inverting input terminals of the operational amplifiers 22. For example, as shown in FIG. 2, if a current corresponding to an initial binding point voltage outputted by an output terminal G14 of the gamma chip 10 is greater than the preset driving current, the output terminal G14 is directly connected to an inverting input terminal of an operational amplifier 22. A non-inverting input terminal of the operational amplifier 22 is grounded, and no input signal influences the non-inverting input terminal, that is, the initial binding point voltage is directly transmitted to an terminal G14' on the processor 21.

In the driving circuit according to the embodiment of the present disclosure, operational amplifiers 22 built in a data driving chip 20 are used, and then according to whether currents corresponding to the initial binding point voltages outputted by a gamma chip 10 can meet requirements of driving capability of a display panel (i.e., determining whether the currents are greater than a preset driving current), for an initial binding point voltages that cannot meet the requirements of driving capability, a first type of output terminals corresponding thereto are connected to a non-inverting input terminal of an operational amplifier 22, so that the current of the initial binding point voltage can be amplified through the operational amplifier 22. After amplification, the current of the output binding point voltage increases, which can meet the requirements of the driving capability and be transmitted to a corresponding terminal on a processor 21. An initial binding point voltage that already can meet the requirements of the driving capability does not need to be amplified, a second type of output terminals corresponding to the initial binding point voltage can be connected to an inverting input terminal of an operational amplifier 22, and the initial binding point voltage is directly transmitted to the processor 21 through the inverting input terminal. A non-inverting input terminal of the operational amplifier 22 is grounded and the input is zero. With such a connection, the corresponding operational amplifier 22 has no amplification effect, and the initial binding point voltage generated by the gamma chip 10 is directly transmitted to the corresponding terminal on the processor 21. Different initial binding point voltages are connected in different manners by using the built-in operational amplifiers 22, so that the binding point voltages input to the processor 21 can meet the requirements of the driving capability of the display panel. The driving circuit features a simple structure and a low cost.

In one embodiment, as shown in FIG. 2, the operational amplifier 22 is a voltage follower. The voltage follower is an electronic element that enables an output voltage to follow an input voltage. The voltage follower has notable characteristics of high input impedance and low output impedance. Generally, the input impedance may be several megohms, while the output impedance is low, usually only a few ohms or less. A voltage amplification factor of the voltage follower is always less than and close to 1, and a current of an output signal can be amplified. The operational amplifiers 22 on the data driving chip 20 in the embodiment of the present disclosure are voltage followers. After the initial binding point voltages outputted by the first type of output terminals of the gamma chip 10 pass through the corresponding voltage followers, potentials of the output binding point voltages are basically unchanged, but the currents are amplified, that is, the driving capability is amplified, which meets the requirements of the driving capability of the display panel.

In the driving circuit according to the embodiment of the present disclosure, the operational amplifiers 22 in the data driving chip 20 are voltage followers, and mainly play a role of voltage following and current amplification, so that potentials of new binding point voltages generated after amplification can meet a binding point voltage level, and currents thereof can meet the requirements of the driving capability of the display panel.

In one embodiment, as shown in FIG. 2, the driving circuit further includes: a first resistor R1 with one end connected to the first type of output terminals of the gamma chip 10 and the other end connected to the non-inverting input terminals of the corresponding operational amplifiers 22.

In one embodiment, as shown in FIG. 2, the driving circuit further includes: a second resistor R2 with one end connected to the second type of output terminals of the gamma chip 10 and the other end connected to inverting input terminals of the corresponding operational amplifiers 22; and a third resistor R3 with one end connected to the non-inverting input terminals of the operational amplifiers 22 and the other end grounded.

In one embodiment, as shown in FIG. 2, the first resistor R1 is a zero-ohm resistor. The zero-ohm resistor, also known as a jumper resistor, is a special-purpose resistor. The zero-ohm resistor is a resistor with a very small resistance value rather than a zero resistance value. With the use of the zero-ohm resistor, the current driving capability of the initial binding point voltages outputted by the first type of output terminals is almost unchanged after passing through the zero-ohm resistor, and the loss of the driving capability of the binding point voltages transmitted to the operational amplifiers 22 can be guaranteed to be minimum.

In one embodiment, as shown in FIG. 2, the second resistor R2 and the third resistor R3 are both zero-ohm resistors. As above, with the use of the zero-ohm resistors, the loss of the driving capability of the binding point voltages can be guaranteed to be minimum. Moreover, the zero-ohm third resistor R3 connected to the non-inverting input terminals of the operational amplifiers 22 is grounded, so that the operational amplifiers 22 can be single-point grounded and become independent systems respectively with strong anti-interference capability.

In another aspect, the embodiments of the present disclosure further provide a method for determining connection information of a driving circuit, wherein the driving circuit includes: a gamma chip 10 configured to provide a plurality of initial binding point voltages; and a data driving chip 20. The data driving chip 20 includes a processor 21 and a plurality of operational amplifiers 22, output terminals of the operational amplifiers 22 are correspondingly connected to terminals on the processor 21, and the output terminals of the operational amplifiers 22 are further connected to their own inverting input terminals.

Figure 3:
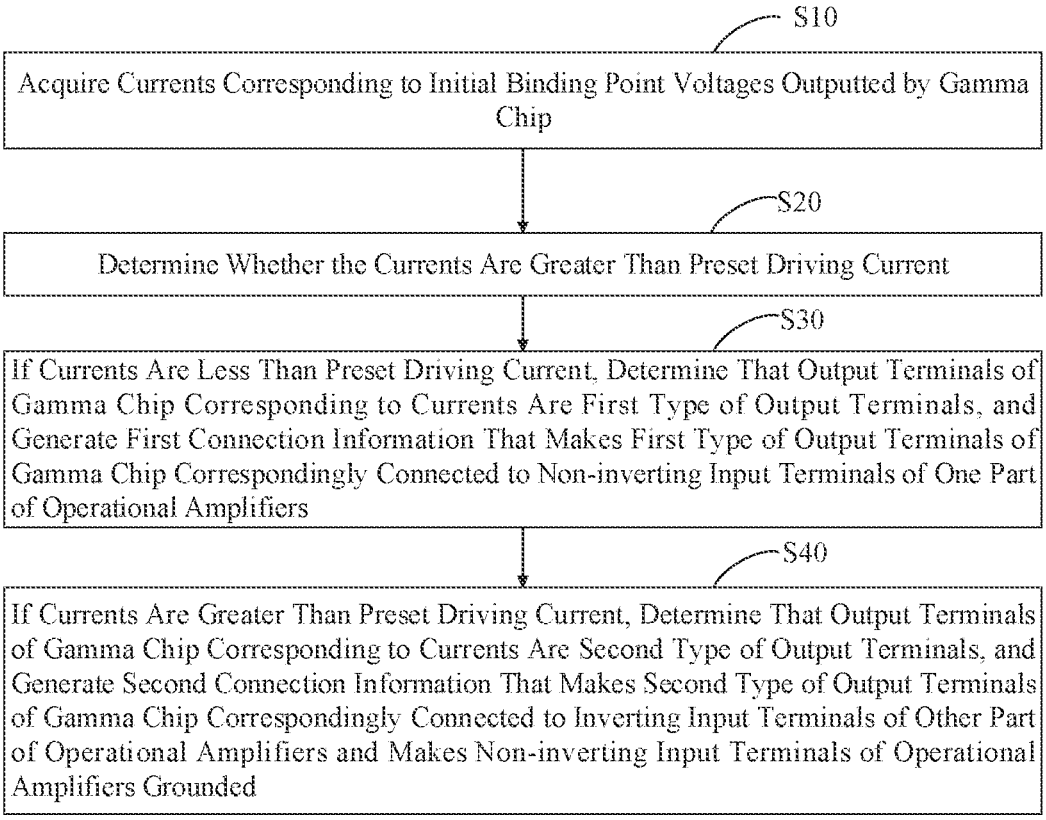
FIG. 3 is a schematic flow chart of a method for determining connection information of a driving circuit according to an embodiment.

As shown in FIG. 3, a method for determining connection information of a driving circuit includes:

S10: Currents corresponding to the initial binding point voltages outputted by a gamma chip are acquired.

S20: It is determined whether the currents are greater than a preset driving current.

S30: If the currents are less than the preset driving current, it is determined that output terminals of the gamma chip corresponding to the currents are a first type of output terminals, and first connection information that makes the first type of output terminals of the gamma chip correspondingly connected to non-inverting input terminals of one part of the operational amplifiers is generated.

S40: If the currents are greater than the preset driving current, it is determined that the output terminals of the gamma chip corresponding to the currents are a second type of output terminals, and second connection information that makes the second type of output terminals of the gamma chip correspondingly connected to inverting input terminals of the other part of the operational amplifiers and makes non-inverting input terminals of the operational amplifiers grounded is generated;

the preset driving current is a current representing driving capability required for driving a display panel, and an output terminal of the data driving chip is connected to the display panel.

The definitions of the gamma chip and the like are the same as those in the above embodiments and are not repeated herein. An existing gamma chip and a data driving chip need to be connected, so that a relationship between a gamma voltage received by the data driving chip and a gray scale can be close to or infinitely close to the gamma 2.2 curve. Specifically, first, currents corresponding to the initial binding point voltages outputted by a gamma chip are acquired, a magnitude relationship between each current and a preset driving current is determined, if the current is less than the preset driving current, it indicates that the initial binding point voltage corresponding to the current cannot meet the requirements of the driving capability of the display panel, the output terminals of the gamma chip are a first type of output terminals, and first connection information is generated. The first connection information is information that makes the first type of output terminals of the gamma chip connected to non-inverting input terminals of the operational amplifiers. After the first type of output terminals of the gamma chip are connected to the non-inverting input terminals of the operational amplifiers, the initial binding point voltages outputted by the first type of output terminals of the gamma chip can be transmitted to corresponding terminals on the processor after currents thereof are amplified by the corresponding operational amplifiers. For a situation where a current corresponding to an initial binding point voltage is greater than the preset driving current, it indicates that the initial binding point voltage already can meet the requirements of the driving capability of the display panel, the output terminals of the gamma chip are determined as a second type of output terminals, and second connection information is generated. The second connection information is information that makes the second type of output terminals of the gamma chip connected to an inverting input terminal of an operational amplifier corresponding thereto and makes a non-inverting input terminal of the operational amplifier grounded, that is, input of the non-inverting input terminal is zero. Initial binding point voltages outputted by the second type of output terminals are directly transmitted to corresponding terminals on the processor through the inverting input terminals. With the method, by using operational amplifiers built in a data driving chip, whether an amplification function of the operational amplifiers is selected is implemented by a simple circuit connection, so that binding voltages output to terminals (G1' to G14') on the processor can meet the requirements of the driving capability of the display panel. The method features a simple structure and a low cost.

Figure 4:
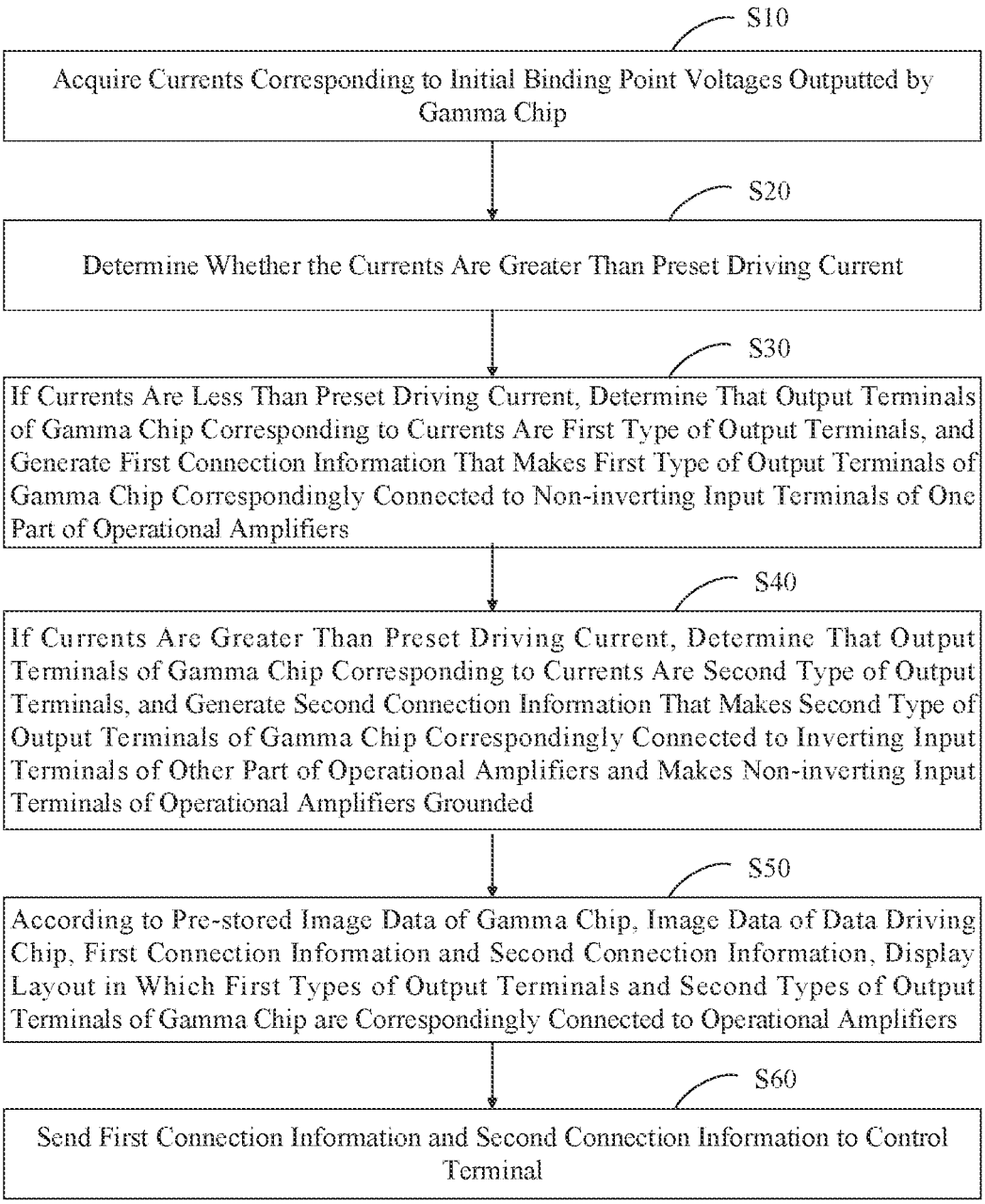
FIG. 4 is a schematic flow chart of a method for determining connection information of a driving circuit according to another embodiment.

In one embodiment, as shown in FIG. 4, the method for determining connection information of the driving circuit further includes the following step.

S50: A layout in which the first types of output terminals and the second types of output terminals of the gamma chip are correspondingly connected to the operational amplifiers is displayed according to pre-stored image data of the gamma chip, image data of the data driving chip, the first connection information and the second connection information.

The above image data may represent feature parameters capable of reflecting a real object image or the like. Manual operations or machine operations may be often required in subsequent samples or production. To facilitate subsequent operations, an image of the gamma chip and an image of the data driving chip maybe displayed according to pre-stored generated according to pre-stored image data of the gamma chip and image data of the data driving chip, then wiring between the first and second types of output terminals of the gamma chip and the operational amplifiers may be generated according to coordinates of the output terminals in the image data of the gamma chip, coordinates of ports of the processor in the gamma chip and the first and second connection information, and then an architecture diagram of the driving circuit is generated, to guide workers to work according to the displayed layout.

In one embodiment, as shown in FIG. 4, the method for determining connection information of the driving circuit further includes the following step.

In S60, the first connection information and the second connection information are sent to a control terminal.

The control terminal includes a personal computer (PC), a controller, and the like. For example, in a workshop, a controller in an industrial robot receives the first connection information and the second connection information. The control terminal may also be a PC, and the first connection information and the second connection information are sent to the PC. After receiving the connection information, the PC may store corresponding parameters (number, coordinates of pins on a console, and the like) of the gamma chip and the data driving chip in a manner of corresponding to the received connection information. On the one hand, it is conducive to providing a modification basis for later maintenance. On the other hand, a manufacturing scheme for the driving circuit is generated according to the received first connection information and second connection information and the stored parameters of the gamma chip and parameters of the data driving chip, to instruct an actuator to perform production operations.

It should be understood that although steps in the flow charts of FIG. 3 to FIG. 4 are displayed in a proper sequence indicated by the arrows, the steps are not necessarily performed in the order indicated by the arrows. Unless expressly described herein, there is no strict order in which the steps are performed, and the steps can be performed in other orders. Moreover, at least a part of the steps in FIG. 3 to FIG. 4 may include a plurality of sub-steps or stages. The sub-steps or stages are not necessarily performed at the same time, but can be performed at different times. The sub-steps or stages are not necessarily performed in a proper sequence, but may be performed in turn or alternately with other steps or at least a part of sub-steps or stages of other steps.

Figure 5:
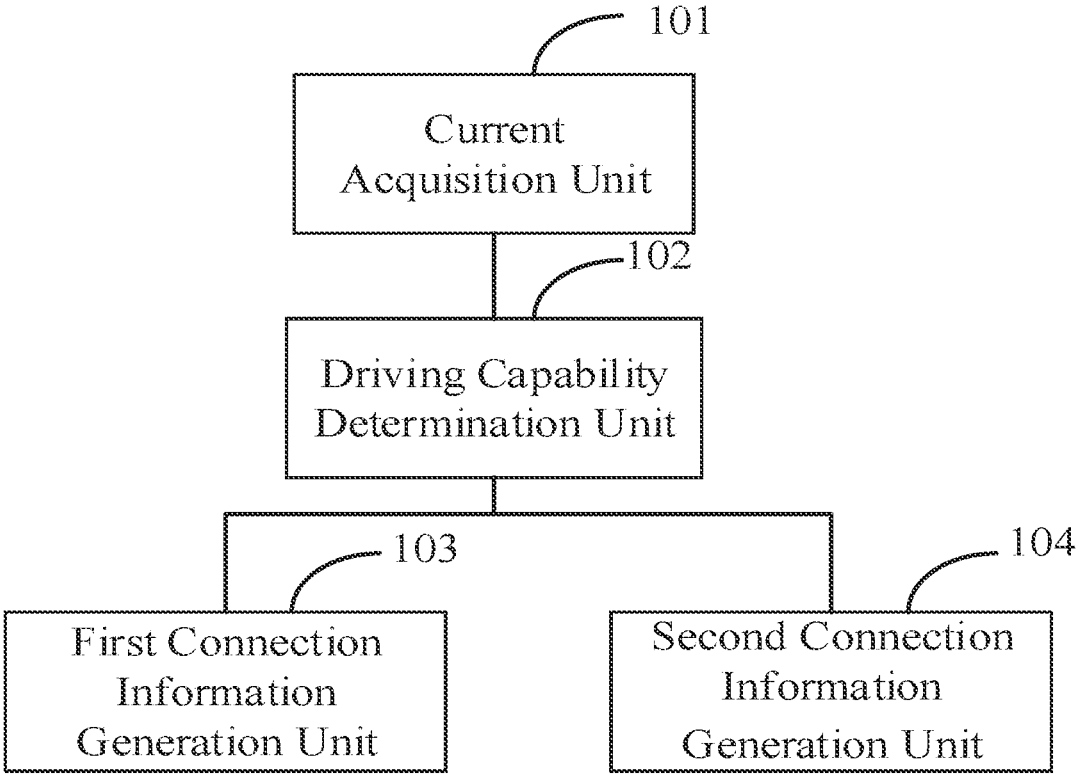
FIG. 5 is a schematic flow chart of an apparatus for determining connection information of a driving circuit according to an embodiment.

An embodiment of the present disclosure further provides an apparatus for determining connection information of a driving circuit, as shown in FIG. 5, including:

a current acquisition unit 101 configured to acquire currents corresponding to the initial binding point voltages outputted by the gamma chip;

a driving capability determination unit 102 configured to determine whether the currents are greater than a preset driving current;

a first connection information generation unit 103 configured to, if the currents are determined to be less than the preset driving current, determine that the output terminals of the gamma chip corresponding to the currents are a first type of output terminals, and generate first connection information that makes the first type of output terminals of the gamma chip correspondingly connected to non-inverting input terminals of one part of the operational amplifiers; and a second connection information generation unit 104 configured to, if the currents are determined to be greater than the preset driving current, determine that the output terminals of the gamma chip corresponding to the currents are a second type of output terminals, and generate second connection information that makes the second type of output terminals of the gamma chip correspondingly connected to inverting input terminals of the other part of the operational amplifiers and makes non-inverting input terminals of the operational amplifiers grounded;

the preset driving current is a current representing driving capability required for driving a display panel, and an output terminal of the data driving chip is connected to the display panel.

Figure 6:
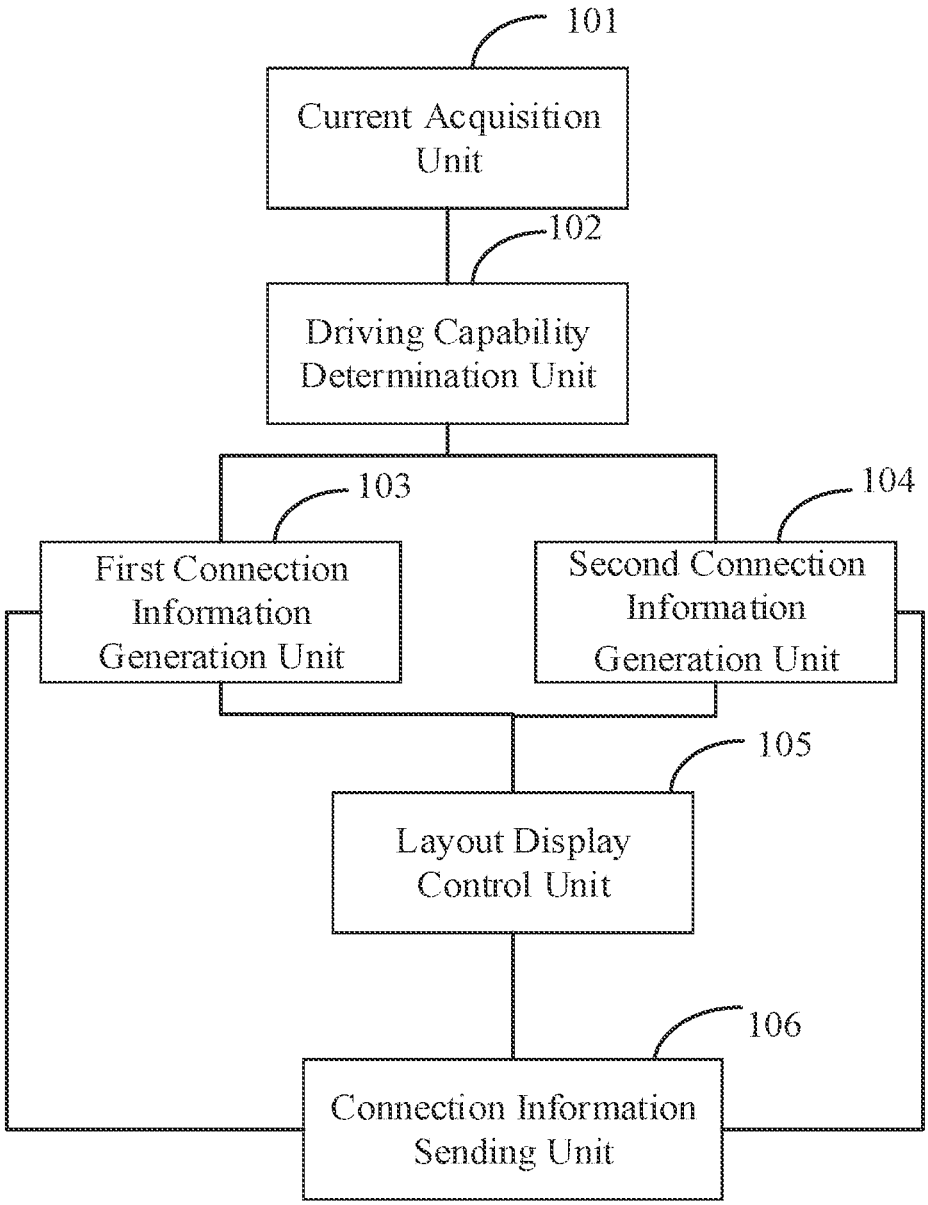
FIG. 6 is a schematic flow chart of an apparatus for determining connection information of a driving circuit according to another embodiment.

In one embodiment, as shown in FIG. 6, the apparatus for determining connection information of the driving circuit further includes:

a layout display control unit 105 configured to display, according to pre-stored image data of the gamma chip, image data of the data driving chip, the first connection information and the second connection information, a layout in which the first types of output terminals and the second types of output terminals of the gamma chip are correspondingly connected to the operational amplifiers.

In one embodiment, as shown in FIG. 6, the apparatus for determining connection information of the driving circuit further includes:

a connection information sending unit 106 configured to send the first connection information and the second connection information to a control terminal.

The specific definition of the apparatus for determining connection information of a driving circuit can be obtained with reference to the above definition of the method for determining connection information of a driving circuit, and is not repeated herein. Modules in the apparatus for determining connection information of a driving circuit can be implemented in whole or in part through software, hardware and a combination thereof. The above modules can be embedded in or independent of a processor of a computer device in a form of hardware, or stored in a memory of the computer device in a form of software, so that the processor can call and perform operations corresponding to the above modules.

Figure 7:
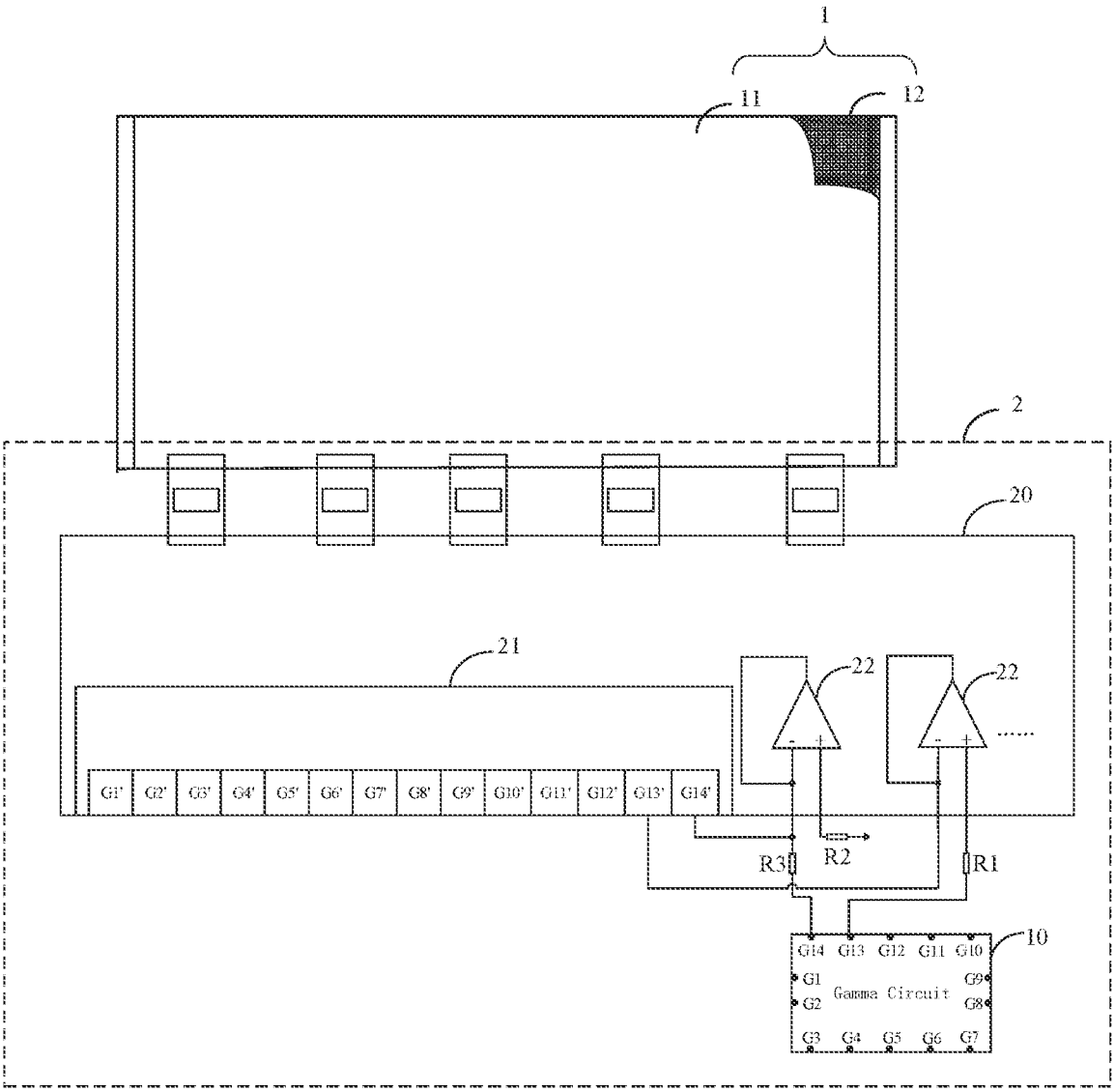
FIG. 7 is a schematic structural diagram of a display device according to an embodiment.

A display device, as shown in FIG. 7, includes a display panel 1 and the driving circuit 2 described above. The driving circuit 2 provides binding point voltages meeting the requirements of the driving capability for driving the display panel 1, which are then transmitted to the display panel 1 after subsequent processing for display drive. The display panel 1 may be a liquid crystal display panel, an Organic Light-Emitting Diode (OLED) display panel, or the like. The display panel 1 may include an array substrate 12 and a color filter 11. With the display device according to the embodiment of the present disclosure, an initial binding point voltage with insufficient driving capability is amplified by using an OP 22 (Operational Amplifier) built in a data driving chip 20, the amplified new binding point voltage is transmitted to a processor 21 on the data driving chip 20, and gamma correction is performed on a data signal to drive the display panel 1 for display. The display quality is good. It needs to be noted that a plurality of data driving chips may be provided. A new binding point voltage outputted by an operational amplifier 22 on each data driving chip 20 is transmitted to the processor 21 on each data driving chip 20, so that the number of binding point voltages finally output by the processor on the data driving chip 20 meets driving requirements.

Figure 8:
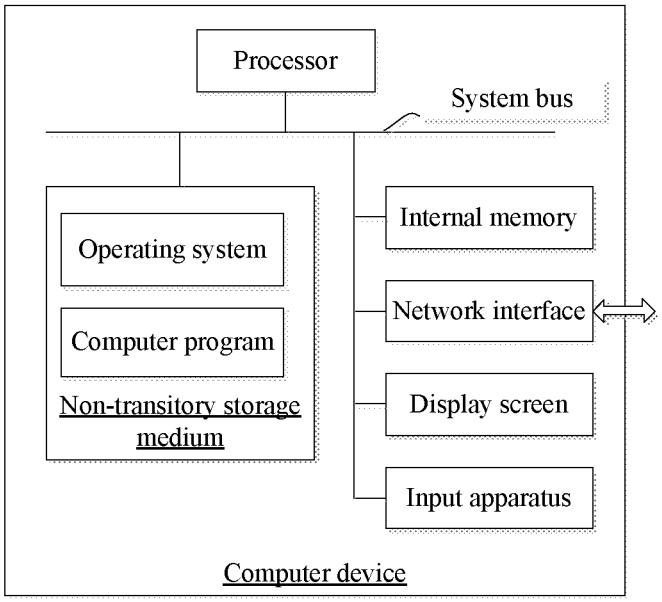
FIG. 8 is an internal structural diagram of a computer device according to an embodiment.

In one embodiment, a computer device is provided. The computer device may be a terminal, and an internal structural diagram thereof may be as shown in FIG. 8. The computer device includes a processor, a memory, a network interface, a display screen and an input apparatus connected through a system bus. The processor of the computer device is configured to provide computing and control capability. The memory of the computer device includes a non-transitory storage medium and an internal memory. The non-transitory storage medium stores an operating system and a computer program. The internal memory provides an environment for the operation of the operating system and the computer program in the non-transitory storage medium. The network interface of the computer device is configured to be connected to and communicate with an external terminal through a network. A method for determining connection information of a driving circuit is implemented when the computer program is executed by the processor. The display screen of the computer device may be a liquid crystal display or an electronic ink display. The input apparatus of the computer device may be a touch layer covering the display screen, a key, a trackball or a trackpad provided on an enclosure of the computer device, or an external keyboard, trackpad or mouse.

It would be appreciated by those skilled in the art that, the structure shown in FIG. 8 is only a block diagram of a partial structure related to the solution of the present disclosure, but does not limit the computer device to which the solution of the present disclosure is applied. Specifically, the computer device may include more or fewer components than those shown in the figure, or some components in combination, or have different component arrangements.

A compute device includes a memory and a processor. The memory stores a computer program. When the processor executes the computer program, the following steps are implemented.

S10: Currents corresponding to the initial binding point voltages outputted by the gamma chip are acquired.

S20: It is determined whether the currents are greater than a preset driving current.

S30: If the currents are less than the preset driving current, it is determined that the output terminals of the gamma chip corresponding to the currents are a first type of output terminals, and first connection information that makes the first type of output terminals of the gamma chip correspondingly connected to non-inverting input terminals of one part of the operational amplifiers is generated.

S40: If the currents are greater than the preset driving current, it is determined that the output terminals of the gamma chip corresponding to the currents are a second type of output terminals, and second connection information that makes the second type of output terminals of the gamma chip correspondingly connected to inverting input terminals of the other part of the operational amplifiers and makes non-inverting input terminals of the operational amplifiers grounded is generated;

wherein the preset driving current is a current representing driving capability required for driving a display panel, and an output terminal of the data driving chip is connected to the display panel.

With the computer device according to the embodiment of the present disclosure, it may be determined according to an initial binding point voltage outputted by a gamma chip whether a corresponding current meets requirements of driving capability, and if it is determined that the corresponding current meets the requirements of the driving capability, first connection information is generated. The first connection information makes a first type of output terminals not meeting the requirements of the driving capability connected to non-inverting input terminals of operational amplifiers, and an amplification function of the operational amplifiers is used. If it is determined that the corresponding current can meet the requirements of the driving capability, second connection information is generated. The second connection information makes a second type of output terminals of the gamma chip connected to inverting input terminals of the operational amplifiers and makes the non-inverting input terminals of the operational amplifiers grounded. Therefore, the amplification function of the operational amplifiers is not used. Initial binding point voltages outputted by the second type of output terminals of the gamma chip are directly transmitted to corresponding terminals on the processor of the data driving chip through the inverting input terminals of the operational amplifiers.

It needs to be noted that the processor of the computer device according to the embodiment of the present disclosure can also implement other steps in the method for determining connection information of a driving circuit.

A computer-readable storage medium stores a computer program. When the computer program is executed by a processor, the following steps are implemented.

S10: Currents corresponding to the initial binding point voltages outputted by the gamma chip are acquired.

S20: It is determined whether the currents are greater than a preset driving current.

S30: If the currents are less than the preset driving current, it is determined that the output terminals of the gamma chip corresponding to the currents are a first type of output terminals, and first connection information that makes the first type of output terminals of the gamma chip correspondingly connected to non-inverting input terminals of one part of the operational amplifiers is generated.

S40: If the currents are greater than the preset driving current, it is determined that the output terminals of the gamma chip corresponding to the currents are a second type of output terminals, and second connection information that makes the second type of output terminals of the gamma chip correspondingly connected to inverting input terminals of the other part of the operational amplifiers and makes non-inverting input terminals of the operational amplifiers grounded is generated;

the preset driving current is a current representing driving capability required for driving a display panel, and an output terminal of the data driving chip is connected to the display panel.

Those of ordinary skill in the art may understand that implementation of all or some of processes in the method of the above embodiment may be completed by a program instructing relevant hardware, the program may be stored in a computer-readable storage medium, and the computer program, when executed, may include, for example, a process of the foregoing method embodiment. Any reference to the memory, storage, database or other media used in the embodiments provided in the present disclosure may include a non-transitory memory and/or a transitory memory. The non-transitory memory may include a read-only memory (ROM), a programmable ROM (PROM), an electrically programmable ROM (EPROM), an electrically erasable programmable ROM (EEPROM) or a flash memory. The transitory memory may include a random access memory (RAM) or an external cache memory. As an illustration rather than a limitation, the RAM available in many forms, such as a static RAM (SRAM), a dynamic RAM (DRAM), a synchronous DRAM (SDRAM), a double data rate SDRAM (DDRSDRAM), an enhanced SDRAM (ESDRAM), a Synchlink DRAM (SLDRAM), a memory bus (Rambus) direct RAM (RDRAM), a direct memory bus dynamic RAM (DRDRAM), a memory bus dynamic RAM (RDRAM), and the like.

The technical features of the above embodiments may be arbitrarily combined. For the sake of brevity, all possible combinations of the technical features in the above embodiments are not described. However, if there is no contradiction in the combinations of the technical features, the combinations shall be considered to be within the scope of the specification.

The above embodiments represent only several implementations of the present disclosure, which are described more specifically and in detail, but are not to be construed as limiting the scope of the present disclosure. It should be noted that, for those of ordinary skill in the art, a number of transformations and improvements can also be made without departing from the conception of the present disclosure, and all these transformations and improvements fall within the protection scope of the present disclosure. Therefore, the protection scope of the present disclosure shall be subject to the appended claims.

The invention claimed is:

1. A driving circuit, comprising:

a gamma chip configured to provide a plurality of initial binding point voltages; the gamma chip comprising a first type of output terminals and a second type of output terminals, currents corresponding to the initial binding point voltages outputted by the first type of output terminals being less than a preset driving current; and currents corresponding to the initial binding point voltages outputted by the second type of output terminals being greater than the preset driving current; and a data driving chip comprising a processor and a plurality of operational amplifiers, output terminals of the operational amplifiers being correspondingly connected to terminals on the processor and being further connected to their own inverting input terminals; the first type of output terminals of the gamma chip being connected to non-inverting input terminals of one part of the operational amplifiers; and the second type of output terminals of the gamma chip being connected to the inverting input terminals of the other part of the operational amplifiers, and the non-inverting input terminals of the operational amplifiers being grounded;

wherein the preset driving current is a current representing driving capability required for driving a display panel, and an output terminal of the data driving chip is connected to the display panel.

2. The driving circuit according to claim 1, wherein the plurality of operational amplifiers are voltage followers.

3. The driving circuit according to claim 2, further comprising:

a first resistor with one end connected to the first type of output terminals of the gamma chip and the other end connected to the non-inverting input terminals of the corresponding operational amplifiers.

4. The driving circuit according to claim 2, further comprising:

a second resistor with one end connected to the second type of output terminals of the gamma chip and the other end connected to inverting input terminals of the corresponding operational amplifiers; and a third resistor with one end connected to the non-inverting input terminals of the operational amplifiers and the other end grounded.

5. The driving circuit according to claim 3, wherein the first resistor is a zero-ohm resistor.

6. The driving circuit according to claim 4, wherein the second resistor and the third resistor are both zero-ohm resistors.

7. The driving circuit according to claim 1, wherein the initial binding point voltages one-to-one correspond to the operational amplifiers.

8. A method for determining connection information of a driving circuit, wherein the driving circuit comprises: a gamma chip configured to provide a plurality of initial binding point voltages; and a data driving chip comprising a processor and a plurality of operational amplifiers, output terminals of the operational amplifiers being correspondingly connected to terminals on the processor and being further connected to their own inverting input terminals; wherein the method comprises:

acquiring, by a processor of a computer device, currents corresponding to the initial binding point voltages outputted by the gamma chip;

determining, by the processor of the computer device, whether the currents are greater than a preset driving current;

when the currents are less than the preset driving current, determining, by the processor of the computer device, that the output terminals of the gamma chip corresponding to the currents are a first type of output terminals, and generating, by the processor of the computer device, first connection information that makes the first type of output terminals of the gamma chip correspondingly connected to non-inverting input terminals of one part of the operational amplifiers;

when the currents are greater than the preset driving current, determining, by the processor of the computer device, that the output terminals of the gamma chip corresponding to the currents are a second type of output terminals, and generating, by the processor of the computer device, second connection information that makes the second type of output terminals of the gamma chip correspondingly connected to inverting input terminals of the other part of the operational amplifiers and makes non-inverting input terminals of the operational amplifiers grounded;

wherein the preset driving current is a current representing driving capability required for driving a display panel, and an output terminal of the data driving chip is connected to the display panel.

9. The method for determining connection information of the driving circuit according to claim 8, further comprising:

displaying, by the processor of the computer device, a connection layout of the driving circuit according to pre-stored image data of the gamma chip, image data of the data driving chip, the first connection information and the second connection information.

10. The method for determining connection information of the driving circuit according to claim 8, further comprising:

displaying, by the processor of the computer device, an image of the gamma chip and an image of the data driving chip according to pre-stored image data of the gamma chip and image data of the data driving chip.

11. The method for determining connection information of the driving circuit according to claim 8, wherein the plurality of operational amplifiers are voltage followers.

12. The method for determining connection information of the driving circuit according to claim 9, further comprising:

generating, by the processor of the computer device, an architecture diagram of the driving circuit according to the connection layout of the driving circuit.

13. The method for determining connection information of the driving circuit according to claim 8, further comprising:

sending, by the processor of the computer device, the first connection information and the second connection information to a control terminal.

14. The method for determining connection information of the driving circuit according to claim 13, further comprising:

after receiving the first connection information and the second connection information, storing, by the control terminal, corresponding parameters of the gamma chip and parameters of the data driving chip in a manner of corresponding to the received first connection information and second connection information.

15. The method for determining connection information of the driving circuit according to claim 14, further comprising:

generating, by the control terminal, a manufacturing scheme for the driving circuit according to the received first connection information and second connection information and the stored parameters of the gamma chip and parameters of the data driving chip.

16. A display device, comprising:

a display panel; and a driving circuit comprising:

a gamma chip configured to provide a plurality of initial binding point voltages; the gamma chip comprising a first type of output terminals and a second type of output terminals, currents corresponding to the initial binding point voltages outputted by the first type of output terminals being less than a preset driving current; and currents corresponding to the initial binding point voltages outputted by the second type of output terminals being greater than the preset driving current; and a data driving chip comprising a processor and a plurality of operational amplifiers, output terminals of the operational amplifiers being correspondingly connected to terminals on the processor and being further connected to their own inverting input terminals; the first type of output terminals of the gamma chip being connected to non-inverting input terminals of one part of the operational amplifiers; and the second type of output terminals of the gamma chip being connected to the inverting input terminals of the other part of the operational amplifiers, and the non-inverting input terminals of the operational amplifiers being grounded;

wherein the preset driving current is a current representing driving capability required for driving a display panel, and an output terminal of the data driving chip is connected to the display panel.

17. The display device according to claim 16, wherein the plurality of operational amplifiers are voltage followers.

* * * * *